US009795212B2

(12) United States Patent
Potocka

(10) Patent No.: US 9,795,212 B2
(45) Date of Patent: Oct. 24, 2017

(54) GRILL CLEANING BRUSH

(71) Applicant: Hanna Potocka, St. Clair Shores, MI (US)

(72) Inventor: Hanna Potocka, St. Clair Shores, MI (US)

( * ) Notice: Subject to any disclaimer, the term of this patent is extended or adjusted under 35 U.S.C. 154(b) by 0 days.

(21) Appl. No.: 15/207,807

(22) Filed: Jul. 12, 2016

(65) Prior Publication Data

US 2017/0042320 A1 Feb. 16, 2017

Related U.S. Application Data

(60) Provisional application No. 62/205,519, filed on Aug. 14, 2015.

(51) Int. Cl.

| | |
|---|---|
| ***A47L 13/12*** | (2006.01) |
| ***A46B 9/02*** | (2006.01) |
| ***A46B 15/00*** | (2006.01) |
| ***B25G 1/10*** | (2006.01) |
| ***B25G 3/30*** | (2006.01) |
| *A46B 5/02* | (2006.01) |
| *A46D 1/00* | (2006.01) |
| *A46B 17/08* | (2006.01) |
| *A46B 3/18* | (2006.01) |
| *A46B 7/04* | (2006.01) |

(52) U.S. Cl.

CPC ..... *A46B 15/0081* (2013.01); *B25G 1/102* (2013.01); *B25G 3/30* (2013.01); *A46B 3/18* (2013.01); *A46B 5/026* (2013.01); *A46B 7/04* (2013.01); *A46B 17/08* (2013.01); *A46D 1/0207* (2013.01)

(58) Field of Classification Search

CPC ..... A46B 15/0081; A46B 5/026; A46B 3/18; A46B 7/04; A46B 17/08; A46D 1/0207

USPC ..... 15/111, 160, 206, 236.05

See application file for complete search history.

(56) References Cited

U.S. PATENT DOCUMENTS

| | | | | |
|---|---|---|---|---|
| 2,824,323 | A * | 2/1958 | Oreste | A47J 37/06 15/104.04 |
| 4,422,202 | A * | 12/1983 | Malvasio | A46B 9/06 15/106 |
| 5,373,600 | A * | 12/1994 | Stojanovski | A47L 17/00 15/111 |
| D392,103 | S * | 3/1998 | Zaccheria | 15/175 |
| 5,930,862 | A * | 8/1999 | Garrett | A46B 9/02 15/142 |
| 6,772,466 | B2 * | 8/2004 | Ziegler | A46B 9/02 15/160 |
| 6,966,094 | B1 * | 11/2005 | Rigakos | A47J 37/0786 15/111 |

(Continued)

FOREIGN PATENT DOCUMENTS

| | | | | |
|---|---|---|---|---|
| CH | EP 0924031 | A1 * | 6/1999 | A46B 3/02 |

*Primary Examiner* — Michael Jennings

(74) *Attorney, Agent, or Firm* — Young Basile Hanlon & MacFarlane, P.C.

(57) ABSTRACT

A grill for brush for cleaning the rungs of a grill grate includes a handle and a brush head attached to the handle. The brush head includes a body and bundles of bristles. The bundles are coupled to a first side of the body at a first end of each bristle. The bundles include long-bristle bundles and short-bristle bundles. The bristles of the long-bristle bundles have a first length that is longer than a second length of the bristles of the short-bristle bundles.

6 Claims, 4 Drawing Sheets

(56) References Cited

U.S. PATENT DOCUMENTS

| | | | | |
|---|---|---|---|---|
| 7,168,124 | B2 * | 1/2007 | Dalias | A46B 9/028 15/160 |
| 8,321,988 | B1 * | 12/2012 | Randall | 15/160 |
| 2005/0011029 | A1 * | 1/2005 | Yu | A47L 13/34 15/111 |
| 2005/0086754 | A1 * | 4/2005 | Dalias | A46B 9/028 15/111 |
| 2005/0160544 | A1 * | 7/2005 | Geller | A46B 9/02 15/160 |
| 2006/0207042 | A1 * | 9/2006 | Di Paolo | A46B 5/0095 15/111 |
| 2007/0124879 | A1 * | 6/2007 | Foss | A46B 5/0008 15/106 |

* cited by examiner

GRILL CLEANING BRUSH

CROSS-REFERENCE TO RELATED APPLICATION(S)

This application claims the benefit of U.S. Provisional Application No. 62/205,519, filed Aug. 14, 2015, the entire contents of which are hereby incorporated by reference in its entirety.

TECHNICAL FIELD

This disclosure relates to grill cleaning brushes, and more particularly, to a cleaning brush with varying bristle sizes and configurations for better reach and coverage of the surfaces of grill rungs that may be difficult to reach.

BACKGROUND

A clean grill grate is critical to, at least, good food taste and hygiene. Therefore, it is important to remove grease and oil build up from a grill grate. Cleaning the top surface of a grill grate is not sufficient as grease and oil buildup on other surfaces of a grill grate may, when they vaporize under heat, undesirably flavor food.

SUMMARY

Disclosed herein is a grill brush for cleaning the rungs of a grill grate. The grill brush includes a handle and a brush head attached to the handle. The brush head includes a body and bundles of bristles. The bundles are coupled to a first side of the body at a first end of each bristle. The bundles include long-bristle bundles and short-bristle bundles. The bristles of the long-bristle bundles have a first length that is longer than a second length of the bristles of the short-bristle bundles.

Also disclosed herein is another grill brush for cleaning rungs of a grill grate, each rung having a facing surface, sides, and an opposing surface. The grill brush includes a handle and a brush head attached to the handle. The brush head includes a body and bundles of bristles. The bundles are coupled to a first side of the body at a first end of each bristle. The bundles include long-bristle bundles and short-bristle bundles. The bristles of the long-bristle bundles have a first length that is longer than a second length of bristles of the short-bristle bundles. The long-bristle bundles are disposed between adjacent short-bristle bundles. A bristle of a short-bristle bundle is configured to contact a facing surface of a rung and a bristle of a long-bristle bundle is configured to contact a side of the rung. The first length and the second length are such that the long-bristle bundles and the short-bristle bundles form a contour adapting to a shape of the rung. A second end of a bristle of a long-bristle bundle curves away from a center of the long-bristle bundle toward an adjacent short-bristle bundle and is configured to contact an opposing surface of the rung.

Also disclosed herein is yet another grill brush for cleaning rungs of a grill grate, each rung having a facing surface, sides, and an opposing surface. The grill brush includes a handle and a brush head, attached to the handle. The head includes a body and bundles of bristles coupled to a first side of the body at a first end of each bristle. The bundles include long-bristle bundles and short-bristle bundles. The head also includes transition groups of bristles arranged between the long-bristle bundles and short-bristle bundles. The bristles of the long-bristle bundles have a first length that is longer than a second length of bristles of the short-bristle bundles. The long-bristle bundles are disposed between adjacent short-bristle bundles. A bristle of a short-bristle bundle is configured to contact a facing surface of a rung and a main portion of a bristle of a long-bristle bundle is configured to contact a side of the rung. The bristles of the transition groups transition in lengths between the first length and the second length such that the bristles of long-bristle bundles, the bristles of short-bristle bundles, and the bristles of transition groups form a contour adapting to a shape of the rung. A bristle of a long-bristle bundle abruptly transitions between a main portion of the bristle and a second end of the bristle causing the second end to extend and contact an opposing surface of the rung.

These and other aspects of the present disclosure are disclosed in the following detailed description of the embodiments, the appended claims and the accompanying figures.

BRIEF DESCRIPTION OF THE DRAWINGS

The invention is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
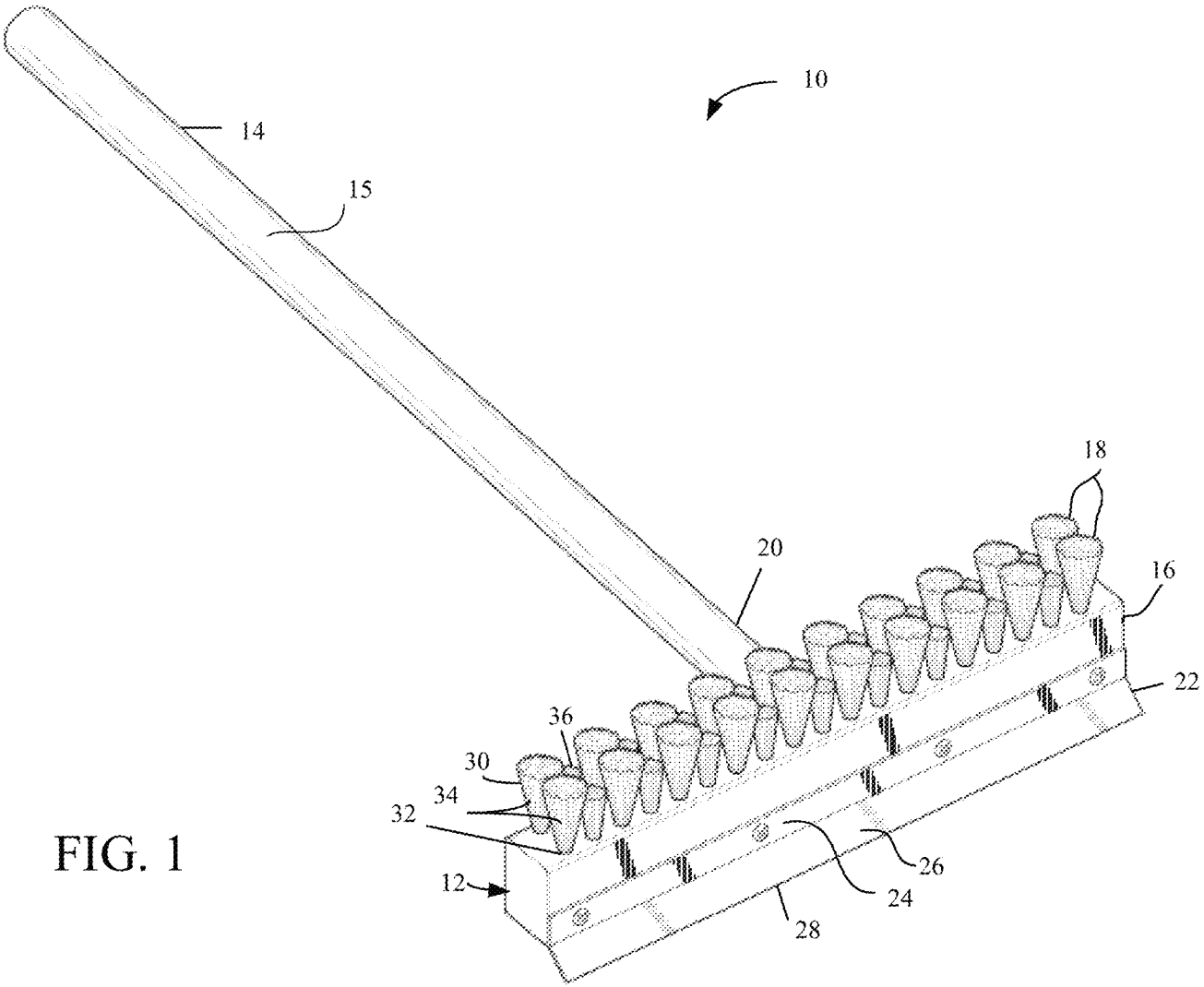
FIG. 1 is a schematic illustration of an exemplary grill cleaning brush.

Referring now to the discussion that follows and also to the drawings, illustrative approaches to the disclosed systems and methods are described in detail. Although the drawings represent some possible approaches, the drawings are not necessarily to scale and certain features may be exaggerated, removed, or partially sectioned to better illustrate and explain the present invention. Further, the descriptions set forth herein are not intended to be exhaustive or otherwise limit or restrict the claims to the precise forms and configurations shown in the drawings and disclosed in the following detailed description.

Figure 2:
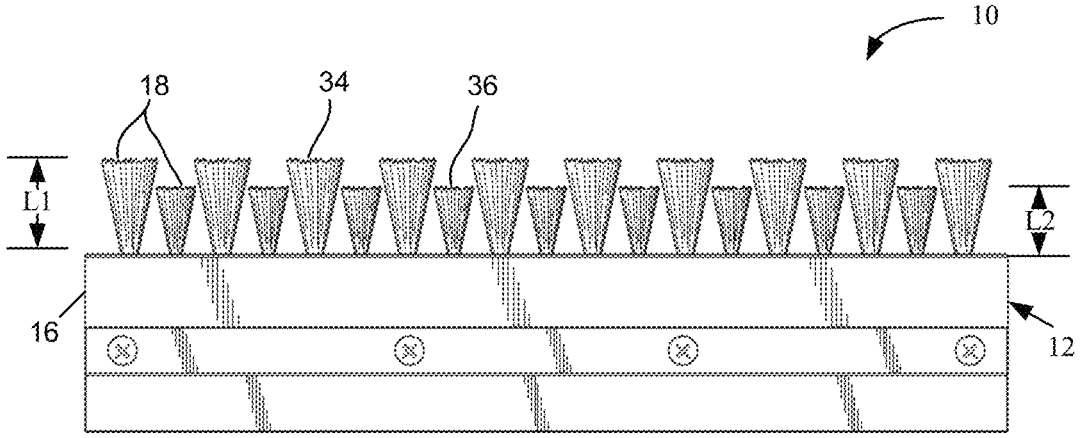
FIG. 2 is a schematic end view of the grill brush of FIG. 1.

With reference to FIGS. 1 and 2, a grill brush 10 may include a brush head 12 attached to a handle 14. The brush head 12 may include a body 16 for supporting a series of elongated brush bristles 18 extending generally laterally outward from the body 16. The brush head 12 may include various shapes and configurations suitable for a particular application. For example, the brush head 12 may employ an elongated generally rectangular-shaped body 16. The body 16 may employ any of various geometric shapes. For example, the configuration illustrated in the drawing figures includes an elongated generally rectangular shape, but other geometric shapes may also be employed, such as polygonal, cylindrical, elliptical, to accommodate the performance and style requirements of a particular application. The body 16 may be constructed from a variety of materials, including but not limited to plastic, metal, wood and composite materials. The body 16 may include a single material or a combination of materials. The body 16 may alternatively be configured differently than illustrated to accommodate a particular application.

The handle 14 may extend generally laterally outward from the body 16. The handle 14 may be constructed from any of a variety of materials, including but not limited to wood, metal and composites. The handle may be constructed from a single material or a combination of materials. Various connection mechanisms may be used to connect an end 20 of the handle to the body 16 depending on the materials employed and whether the handle 14 is intended to be removable or permanently attached to the brush head 12. For example, the connection mechanism may include a threaded connection that enables the handle 14 to be removed from the brush head 12. More permanent connection mechanisms, such as gluing, brazing and welding, may also be employed. Connectors, such as screws, bolts and rivets may also be used to secure the handle 14 to the brush head 12.

The brush head 12 may include additional grill cleaning features along with the brush bristles 18. For example, the brush head 12 may include a scraper bar 22 that may be attached to the body 16. The scraper bar 22 may be formed from a thin sheet of material attached along a first edge 24 to the body 16. An opposite second edge 26 extends beyond the body 16 and provides a scraping edge 28 for scraping a surface of a grill grate. The scraper bar 22 may be made from various materials, and may include for example, metal, plastic and composite material, as well as other materials.

The handle 14 may include a generally smooth surface and may employ various surface treatments and embedded textures that may improve or enhance gripping of the handle. For example, a surface 15 may include knurling, ribs, ridges, dimples, as well as other surface features, which may improve or enhance grasping the handle.

The brush head 12 includes multiple brush bristles 18 that extend laterally outward from the body 16 of the brush head 12. The brush bristles 18 may be constructed from any of a variety of materials to suit the design and performance requirements of a particular application. The brush bristles 18 may include for example, metals, metal alloys, plastics and composite materials, as well as other materials. The brush bristles 18 may also be made of a combination of materials. The brush bristles 18 may further include various surface coatings that may enhance the life of the bristles and/or their cleaning capability. The individual brush bristles 18 may include various geometric shapes. For example, in the illustrated configuration the brush bristles 18 have a generally elongated cylindrical shape. Other geometric shapes may also be employed.

Various attachment mechanisms may be used to attach the brush bristles 18 to the body 16. For example, the brush bristles 18 may be arranged into bristle bundles 30 that may be partially inserted into a recessed pocket 32 formed in the body 16. Multiple bristle bundles 30 may be attached to the body 16. Other attachment mechanisms for connecting the brush bristles 18 to the body 16 may also be employed.

Figure 3:
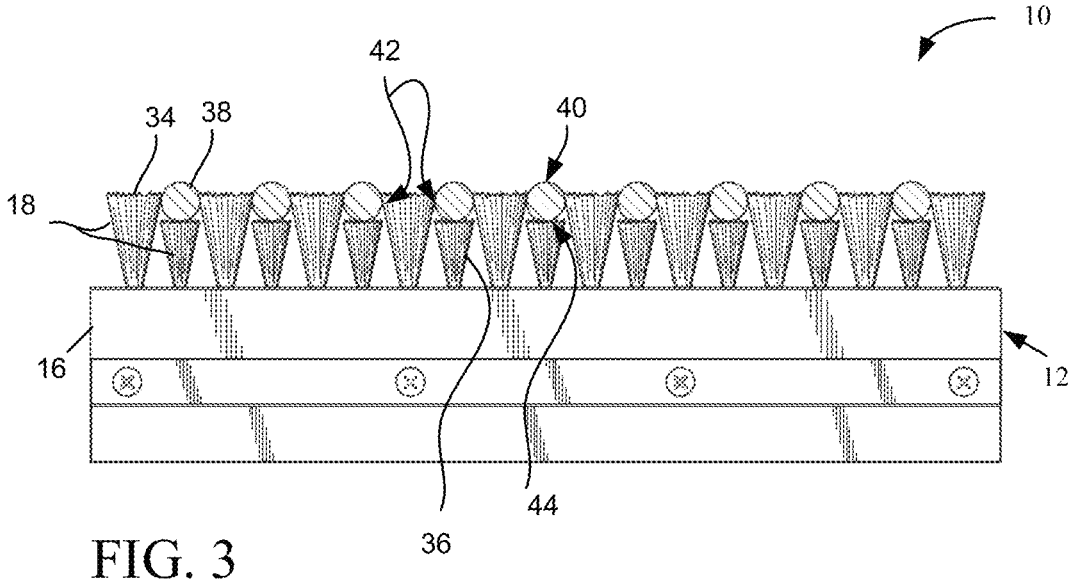
FIG. 3 is a schematic end view of the grill brush of FIG. 1 illustrating brush bristles engaging rungs of a grill grate.

With reference to FIGS. 1-3, to enhance the grill cleaning capability of the grill brush 10, the brush bristles 18 may be arranged in groups of varying lengths. For example, a first brush bristle group 34 may have a first length L1 relative to body 16, and a second brush bristle group 36 may have a second length L2 relative to body 16. The first length L1 of the first brush bristle group 34 may be longer than the second length L2 of the second brush bristle group 36. Brush head 12 may include multiple sets of the first brush bristle group 34 and the second brush bristle group 36. The first and second brush bristle groups 34 and 36 may be alternately arranged, such that each first brush bristle group 34 is separated by a second brush bristle group 36, and vise-versa. Each group (i.e., first and second brush bristle group 34 and 36) may include multiple bristle bundles 30. Multiple bristle bundles 30 within a particular brush bristle group (i.e., first and second brush bristle group 34 and 36) may be arranged generally in a row extending parallel to a longitudinal axis of the handle 14. Alternatively, the multiple bristle bundles 30 within a particular brush bristle group may be arranged in generally non-linier or staged arrangement.

With continued reference to FIGS. 1-3, configuring the brush bristles 18 to have varying lengths enables the longer brush bristles 18 (i.e., the brush bristles 18 of the first brush bristle group 34) to effectively clean regions of a grill grate that may normally be difficult to reach, such as the sides of the rungs of the grill grate. FIG. 3 illustrates the brush bristles 18 engaging individual rungs 38 of a grill grate 40. The varying length of the brush bristles 18 enables the longer brush bristles of the first brush bristle group 34 to engage a side surface 42 of the grill grate 40. The brush bristles 18 of the first brush bristle group 34 are flexible enough to enable the ends of the bristles of the first brush bristle group 34 to be positioned between adjacent rungs 38 of the grill grate 40. The ends of the shorter length brush bristles 18 of the second brush bristle group 36 may contact a facing surface 44 of a rung 38 that faces the ends of the of the shorter length brush bristles 18 and extends between the side surfaces 42 of the rung 38. This particular configuration of the brush bristles 18 enables the grill brush 10 to effectively remove debris from the sides 42 of the grill rungs 38 that may otherwise be difficult to access.

Figure 4:
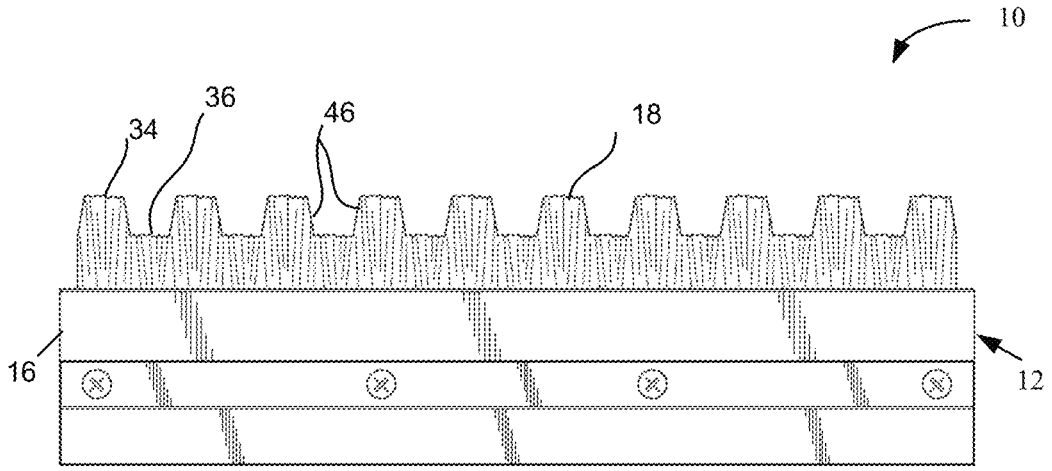
FIG. 4 is a schematic end view of the grill brush employing alternately configured brush bristles.
Figure 5:
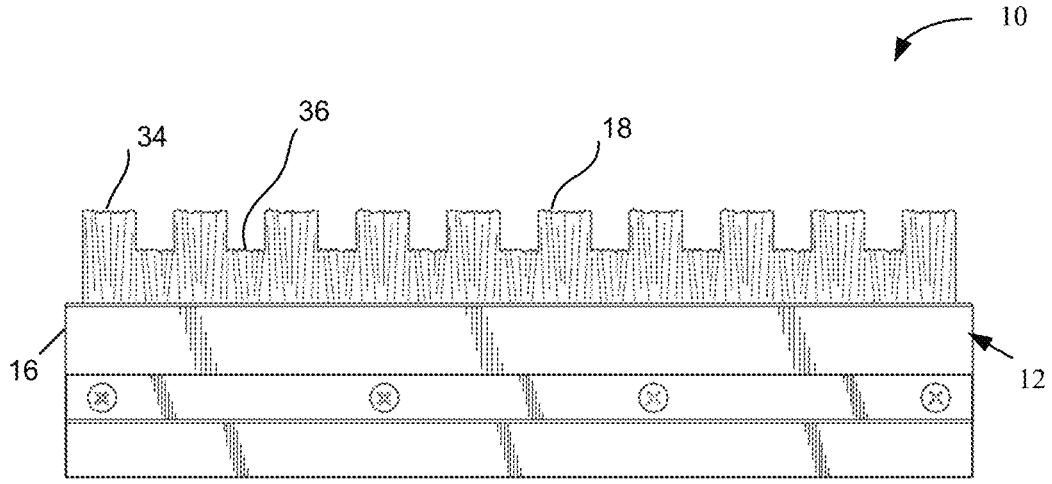
FIG. 5 is a schematic end view of the grill brush employing alternately configured brush bristles.

With reference to FIGS. 4 and 5, the length of the individual brush bristles 18 may be varied to achieve a desired contour that may enhance the cleaning capability of the cleaning grill brush when used in connection with a particular application. For example, the contour may be selected to generally mirror a cross-sectional shape of the rungs 38 of the grill grate 40 to enhance contact between the brush bristles 18 and the grill grate 40. This may be accomplished by configuring groups of brush bristles 18 to have a different length than adjacent groups of brush bristles 18. For example, the first brush bristle group 34 may be configured to have the first length L1 and the second brush bristle group 36 may be configured to have a second length L2 shorter than the first length L1. A group of transition brush bristles 46 may be arranged between the first and second brush bristle groups 34 and 36. The transition brush bristles 46 may have varying lengths that transition between length L1 of the first brush bristle group 34 and length L2 of the second brush bristle group 36. The transition brush bristles 46 may provide a sloped contour extending between the first brush bristle group 34 and the second brush bristle group 36. The brush bristles 18 illustrated in FIG. 5 include the first and second brush bristle groups 34 and 36, but do not include the transition brush bristles 46. The configuration of the brush bristles 18 illustrated in FIG. 5 produces a more abrupt transition between the first brush bristle groups 34 and the second brush bristle group 36. FIGS. 4 and 5 are only a couple examples of the various contours that may be achieved by varying a length of the brush bristles.

Figure 6:
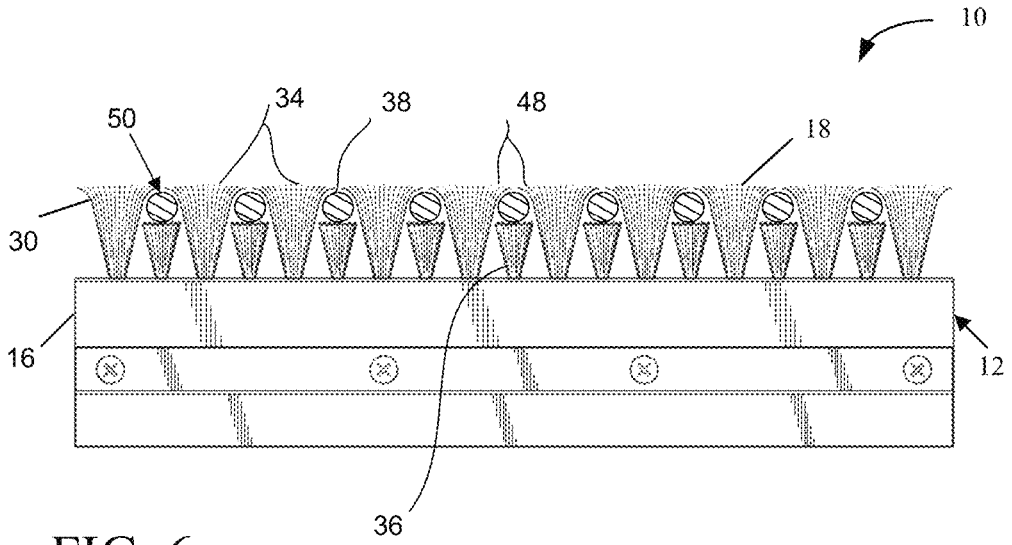
FIG. 6 is a schematic end view of the grill brush employing alternately configured brush bristles.

With reference to FIG. 6, brush bristle ends 48 of at least a portion of the brush bristles 18 of the first brush bristle group 34 may be curved outward away from a center of the bristle bundle 30 toward the adjacent second brush bristle group 36. This may further enhance the cleaning capability of the grill brush 10 by enabling the brush bristle ends 48 of the longer brush bristles 18 of the first brush bristle group 34 to contact an opposing surface 50 of the rungs 38 of the grill grate 40. The opposing surface 50 is the surface of a rung 38 that is substantially 180 degrees opposite the facing surface 44. This may enable more thorough cleaning of an entire circumference of the rungs 38 of the grill grate 40.

Figure 7:
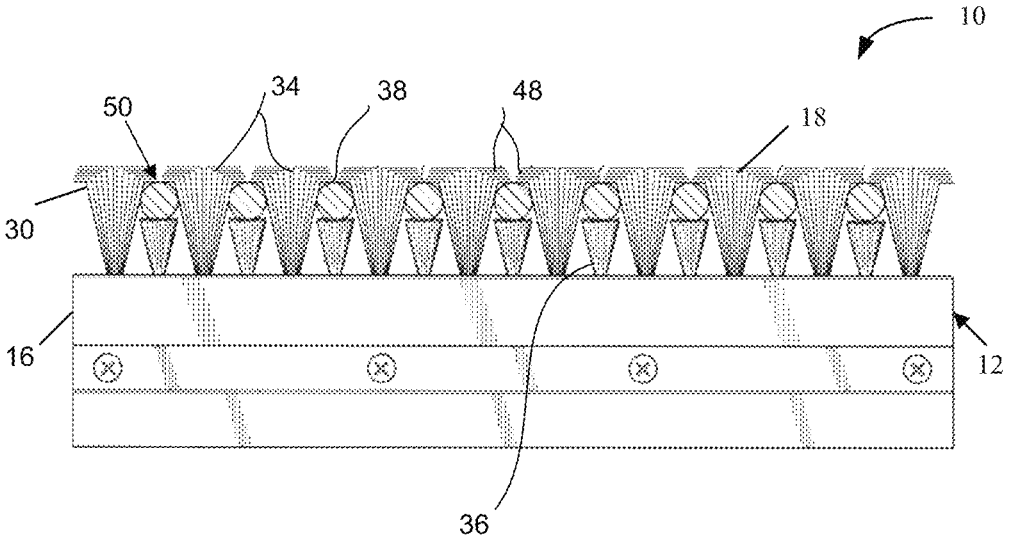
FIG. 7 is a schematic end view of the grill brush employing alternately configured brush bristles.

With reference to FIG. 7, the brush bristle ends 48 of the brush bristles 18 of the first brush bristle group 34 may extend generally parallel to a longitudinal axis of the body 16 of the brush head 12. The brush bristle ends 48 are similarly configured as the brush bristle ends 48 illustrated in FIG. 6, but may include a more abrupt transition between a main portion of the brush bristle and the brush bristle ends 48, whereas the brush bristle ends 18 illustrated in FIG. 6 employ a more gradual transition. Similar to the brush bristles 18 illustrated in FIG. 6, the brush bristle configuration illustrated in FIG. 7 may further enhance the cleaning capability of the grill brush 10 by enabling the brush bristle ends 48 of the longer brush bristles 18 of the first brush bristle group 34 to contact an opposing surface 50 of the rungs 38 of the grill grate 40. This may enable more thorough cleaning of an entire circumference of the rungs 38 of the grill grate 40.

While the invention has been described in connection with certain embodiments, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A grill brush for cleaning rungs of a grill grate, each rung having a facing surface, sides, and an opposing surface, comprising:
- a handle; and
- a brush head, attached to the handle, comprising:
  - a body; and
  - bundles of bristles, coupled to a first side of the body at a first end of each bristle, comprising long-bristle bundles and short-bristle bundles, wherein:
    - bristles of the long-bristle bundles are all longer than bristles of the short-bristle bundles;
    - long-bristle bundles are disposed between adjacent short-bristle bundles;
    - a bristle of a short-bristle bundle is configured to contact a facing surface of a rung;
    - each long-bristle bundle has a first portion of the bristles with a first length and a second portion of the bristles with a second length, the second length being longer than the first length, the second portion being proximate a perimeter of the long-bristled bundle, each bristle of the second portion curving away from a center of the long-bristle bundle toward an adjacent short-bristle bundle and configured to contact an opposing surface of the rung opposite the facing surface.

2. The grill brush of claim 1, further comprising:
- a scraper bar having a first edge attached at a second side of the body, and a second edge that extends beyond the body.

3. A grill brush for cleaning rungs of a grill grate, each rung having a facing surface, sides, and an opposing surface, comprising:
- a handle; and
- a brush head, attached to the handle, comprising:
  - a body; and
  - bundles of bristles, coupled to a first side of the body at a first end of each bristle, comprising long-bristle bundles and short-bristle bundles,
  - wherein:
    - bristles of the long-bristle bundles have a first length that is longer than a second length of bristles of the short-bristle bundles;
    - long-bristle bundles are disposed between adjacent short-bristle bundles;
    - a bristle of a short-bristle bundle is configured to contact a facing surface of a rung and a main portion of a bristle of a long-bristle bundle is configured to contact a side of the rung; and
    - bristles of a long-bristle bundle abruptly bend between a main portion of the bristle and a second end of the bristle such that the second end of the bristle is parallel to the body of the brush head causing the second end to extend and contact an opposing surface of the rung.

4. The grill brush of claim 3, further comprising:
- a scraper bar having a first edge attached at a second side of the body, and a second edge that extends beyond the body.

5. The grill brush of claim 3, wherein the brush head is removably connected to the handle.

6. The grill brush of claim 3, wherein the brush head is permanently connected to the handle.

* * * * *